US006636704B2

(12) United States Patent
Weaver et al.

(10) Patent No.: US 6,636,704 B2
(45) Date of Patent: Oct. 21, 2003

(54) IMAGING SYSTEM HAVING MEDIA STACK COMPONENT MEASURING SYSTEM

(75) Inventors: Jeffrey S. Weaver, Fort Collins, CO (US); David J. Luman, Meridian, ID (US); Phillip R. Luque, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/010,801

(22) Filed: Nov. 13, 2001

(65) Prior Publication Data

US 2003/0091351 A1 May 15, 2003

(51) Int. Cl.[7] ..... G03G 15/00
(52) U.S. Cl. ..... 399/23; 399/45; 399/393
(58) Field of Search ..... 399/13, 16, 23, 399/24, 43, 45, 389, 393

(56) References Cited

U.S. PATENT DOCUMENTS 4,652,110 A * 3/1987 Sato et al.
4,907,887 A * 3/1990 Leonard et al.
5,138,178 A * 8/1992 Wong et al. ..... 399/45 X
5,236,348 A 8/1993 Fetherolf et al.
5,287,340 A * 2/1994 Chapman et al.
5,534,690 A 7/1996 Goldenberg et al.
5,629,672 A 5/1997 Brown et al.
5,960,230 A 9/1999 Peter
6,044,717 A * 4/2000 Biegelsen et al.
6,301,452 B1 * 10/2001 Yoshizawa ..... 399/45
6,385,406 B1 * 5/2002 Funamizu et al. ..... 399/16

* cited by examiner

*Primary Examiner*—Sandra Brase

(57) ABSTRACT

The present invention provides an imaging system and method having a media stack component measuring system for identifying media characteristics. The imaging system includes a printer engine. A printer control system is in communication with the printer engine. A media holder is provided for holding a media stack including a plurality of sheets. A media stack component sensing system is provided which provides an output signal having a thickness component representative of sheet thickness of the sheets in the media stack.

30 Claims, 8 Drawing Sheets

IMAGING SYSTEM HAVING MEDIA STACK COMPONENT MEASURING SYSTEM

THE FIELD OF THE INVENTION

The present invention generally relates to imaging systems, and more particularly to an imaging system and network having a media stack component measuring system and method for identifying media stack characteristics.

BACKGROUND OF THE INVENTION

Generally, an image forming system or device is a device which produces or affixes an image to media. The image may represent text, numeric, graphic, photographic or similar data, or a combination of these. The media is most often in the form of paper sheets, transparency sheets, or photo sensitive sheets arranged in a stack within a supply or media holder (e.g., a paper tray) and are usually drawn for imaging from the media holder a single sheet at a time.

Known media supply sensors and indicators are used to notify an operator that there is a need for replenishing of the media supply. For example, one known mechanical indicator uses a simple lever mechanism to indicate the media level within the supply holder. Electro-mechanical and optical sensors have also been used to indicate a "paper out" condition to the print engine or print controller of the image forming device. These sensors or transducers have also been used to provide a rough approximation of the supply level to the print engine. Only rough approximations have been possible due to the diversity of media types and their inherent characteristics, such as cut paper tolerances, ragged edges, media type, manufacturing and cutting techniques, etc.

Increased abilities of image forming devices to print various quality and specialty images sometimes require that the printing process be tuned to specific media types. Most often, and especially in network printing environments, a user will elect to manually feed the specialized media as opposed to printing from the regular supply tray. This is caused by the fact that there is no known way of insuring that the proper media is present in sufficient quantities in the supply tray. Image forming devices often assume that a specific media is being used when in fact it is not, resulting in an inferior product. Often printing parameters such as toner/ink concentrations, paths speed, fuser temperature and drive torks are altered to optimize printing of specialized images. Hence, using the wrong media can produce inferior results and even damage the image forming device.

In a business printing environment, large print jobs (e.g., 500 sheets) may not be printed during a work day since they tie up the office printer. Officer personnel may start the print job at the end of the day and go home, only to come back the next day and find out that only 30 pages were printed due to an insufficient amount of sheet media in the printer.

Additionally, documents or print jobs may be ordered via a network on a "pay for services" basis. The document is paid for at the time it is ordered. Once the document is ordered, it is downloaded to a printer via the network. Before the printer starts to print the document, a user must make sure the printer has enough sheet media to avoid printing only half of the document and paying for all of it. Once a print job is ordered, it would also be desirable to be assured that the printer media holder contains the correct media and optimized printer settings for the print job.

In a secure printing environment, it may be desirable for a user to know that enough media exists in the media holder to print the print job. A user may not realize that only half the print job was printed. As such, once additional media is added to the media holder, the print job may continue printing from printer memory providing access to restricted or confidential documents by a subsequent user.

Accordingly, it would be desirable to provide a imaging system capable of providing detailed information about the quantity and type of media in the media holder.

SUMMARY OF THE INVENTION

The present invention provides an imaging system and method having a media stack component measuring system for identifying media characteristics. The imaging system includes a printer engine. A printer control system is in communication with the printer engine. A media holder is provided for holding a media stack including a plurality of sheets. A media stack component sensing system is provided which provides an output signal having a thickness component representative of sheet thickness of the sheets in the media stack.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
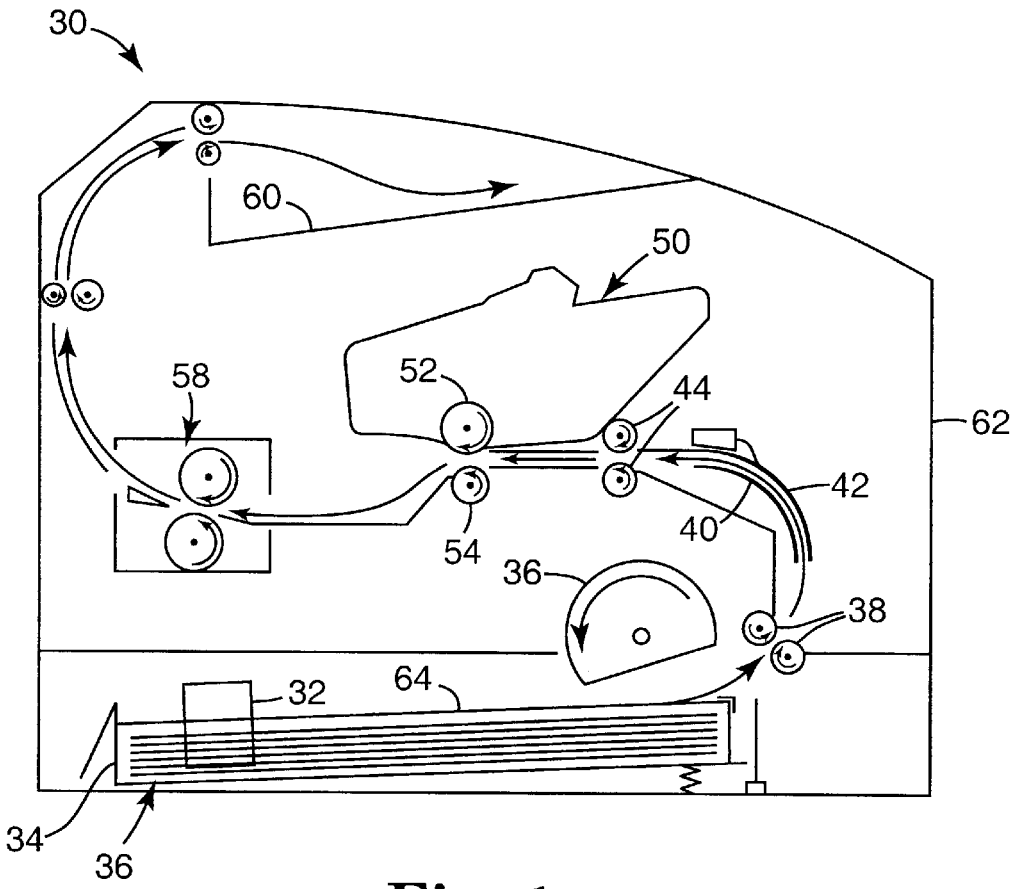
FIG. 1 is a diagram illustrating one exemplary embodiment of an imaging system having a media stack component measuring system according to the present invention.

FIG. 1 is a diagram illustrating one exemplary embodiment of an imaging system according to the present invention, generally at 30. Imaging system 30 includes a media stack component measuring system 32 for identifying media stack characteristics (e.g., number of sheets, sheet thickness, etc.). The media stack characteristics may be used to determine imaging system settings, identification of media types, and media quantity needed for a print job.

For purposes of this disclosure, imaging system 30 is a laser printer that employs an electro photographic drum imaging system, as known in the art. However, as will be obvious to those of ordinary skill in the art, the present invention is similarly applicable to other types of printers and/or imaging devices that employ sheet media including, for example, inkjet printers, facsimile machines, copiers, or the like.

In one embodiment, imaging system 30 includes a media tray or holder 34 which holds a stack of sheet media 36. Media stack component measuring system 32 is positioned immediately adjacent sheet media 36, and may be positioned within media holder 34 or outside of media holder 34. In one aspect, imaging system 30 further includes a feed roller 36, a pair of transport rollers 38, paper guides 40, 42, registration rollers 44, toner cartridge 50 having a photoconductive drum 52, transfer roller 54, fuser rollers 58 and output bin 60, all associated with housing 62. In operation, feed roller 37 picks a top sheet 64 from media stack 36 in media holder 34 and advances it to the pair of transport rollers 38. Transport rollers 38 further advance sheet 64 through paper guides 40 and 42 toward registration rollers 44. Registration rollers 44 advance paper 64 to photoconductive drum 52 (of toner cartridge 50) and transfer roller 54 where toner is applied as conventional in the art. Sheet 64 then moves through heated fuser rollers 58 and toward output bin 60.

Media stack component measuring system 32 is positioned adjacent sheet media stack 36 in media holder 34. Media stack component measuring system 32 operates to sense and detect media stack characteristics, such as the number of sheets in media stack 36 and sheet thickness. These media stack characteristics are used by imaging system 30 to determine sheet availability for print jobs, media types, and adjustment of the imaging system printing settings. One exemplary embodiment of media stack component measuring system 32 is described in detail in this application.

Figure 2:
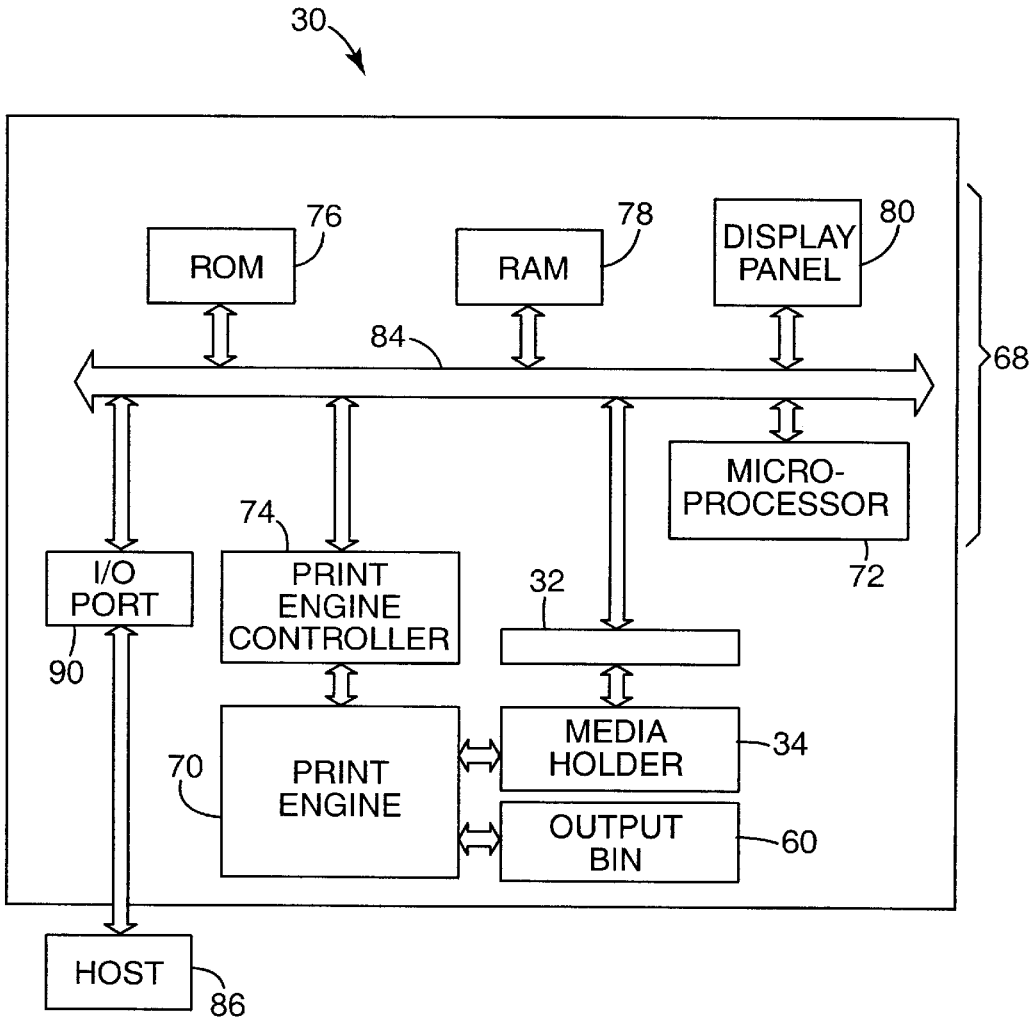
FIG. 2 is a block diagram illustrating one exemplary embodiment of the imaging system of FIG. 1.

FIG. 2 is a system block diagram illustrating one exemplary embodiment of the imaging system 30 of FIG. 1. Imaging system 30 includes a control system 68 in communication with a print engine 70. In one aspect, the control system 68 includes a controller or microprocessor 72, print engine controller 74, read only memory (ROM) 76, random access memory (RAM) 78 (e.g., dynamic RAM), display panel 80 and communications bus 84. Control system 68 for imaging system 30 communicates with a host (e.g., a host computer or network) 86 via communications port (e.g., I/O port) 90.

In one embodiment, imaging system 30 is controlled by microprocessor 72 which communicates with other elements of the system via communications bus 84. Print engine controller 74 and associated print engine 70 connect to communications bus 84 and provide the print output capability for imaging system 30. Sheet media is pulled from media holder 34 into print engine 70 and directed to output and finishing tray or bin 60. Media stack component measuring system 32 is positioned adjacent the sheet media stack located within media holder 34 to sense and detect characteristics of the sheet media stack in media holder 34. In one aspect, media stack component measuring system 32 is used for determining the number of sheets in media holder 34 and sheet thickness. Control system 68 utilizes these components for processing print jobs. In particular, the number of sheets is utilized by control system 68 to determine whether sufficient sheets exist in media holder 34 to complete a print job. Sheet thickness information is utilized by control system 68 to identify the sheet media type and/or optimized print job settings.

In one aspect, port 90 provides communications between imaging system 30 and host 86, and receives page descriptions (or raster data) from the host 86 for processing within the imaging system 30. RAM 78 provides a main memory for the imaging system 30 for storing and processing a print job data stream received from host 86. ROM 76 holds firmware which controls the operation of control system 68 and imaging system 30. The code procedures stored in ROM 76 may include a page converter, rasterizer, compression code, page print scheduler and print engine manager. The page converter firmware converts a page description received from the host to a display command and list, with each display command defining an object to be printed on the page. The rasterizer firmware converts each display command to an appropriate bit map (rasterized strip) and distributes the bit map into memory 78. The compression firmware compresses the rasterized strips in the event insufficient memory exists in memory 78 for holding the rasterized strips. The rasterized strips are passed to print engine 70 by print engine controller 74, thereby enabling the generation of an image (i.e., text/graphics etc.). The page print scheduler controls the sequencing and transferring of page strips to print engine controller 74. The print engine manager controls the operation of print engine controller 74 and, in turn, print engine 70.

ROM 76 further includes a media manager 77 for determining media characteristics using an output signal from media stack component measuring system 32 including the number of sheet media in media holder 34 and media sheet thickness and/or media type according to the present invention. The media account manager receives media component values of media detected by system 32. Although in a preferred embodiment, media manager includes firmware in ROM 76, it is understood that it may also be embodied as software in RAM 78 or in circuitry (such as an ASIC), or as a combination of hardware, software and/or firmware.

Figure 3:
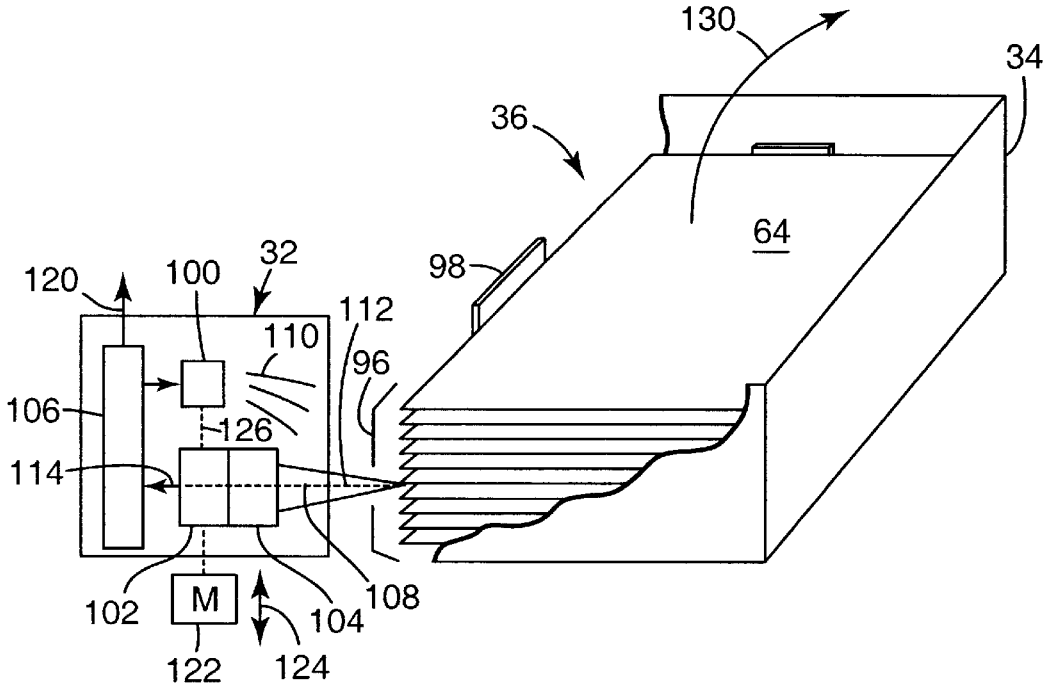
FIG. 3 is a diagram illustrating one exemplary embodiment of a media stack component measuring system adjacent a media holder, according to the present invention.

FIG. 3 is a diagram illustrating one exemplary embodiment of media stack component measuring system 32 positioned adjacent sheet media stack 36. Sheet media stack 36 is located in media holder 34, shown in a cut-away view. In one exemplary embodiment, media holder 34 is a removable tray.

Sheet media stack 36 includes a measured edge or measured side 36 utilized by media stack component measuring system 32. Preferably, measured side 96 is a "registered" side or stack edge. In one aspect, registration of measured side 96 includes sheet media stack 36 being positioned against a common flat surface or plane. Preferably, imaging system 30, and more preferably media holder 34 includes a registration mechanism 98 for registration of measured side 96. Registration mechanism 98 may comprise a mechanical holder for maintaining registration of measured side 96 of sheet media stack 36 (e.g., a spring loaded adjustment member or manual adjustment mechanism). Registration mechanism 98 provides for uniform measurement of measured side 96 by media stack component measuring system 32.

Media stack component measuring system 32 includes a light source 100, a photo sensor or photo diode102, an optical assembly 104 and a sensor circuit 106. Light source 100 is operably positioned to illuminate the measured side 96 of media stack 36. Lens assembly 104 is positioned along an optical path 108 between the measured side 96 and the photo diode 102. Preferably, optical assembly provides a focal spot size smaller than the thickness of a sheet of media in media stack 36. Light source 100 and photo diode are electrically coupled to sensor circuit 106.

In operation, light source 100 illuminates the measured side 106 of the media stack 36, illustrated by illumination lines 110. Light is reflected off of measured side 96, represented by reflected light 112. Optical assembly 104 focuses the reflected light 112 at photo diode 102. Reflected light 112 changes corresponding to whether the light is reflected from an edge of a sheet contained in media stack 36 or whether it is reflected from a location between sheets. A corresponding output signal is provided from photo diode 102 to sensor circuit 106, indicated at 114. Sensor circuit 106 receives the photo dialed output signal 114 and provides a corresponding output signal 120. Output signal 120 provides measurement components representative of characteristics of the media stack 36 and sheets contained within the media stack 36. In one aspect, output signal 120 is provided to microprocessor for signal processing. In another aspect, output signal 120 is provided to a separate controller (e.g., print engine controller 74).

Imaging system 30 further includes a mover or movement mechanism 122 which allows the media stack component measuring system 32 to scan the entire measured edge 96 during operation of the media stack component measuring system 32, indicated by movement arrow 124. In one aspect, mechanism 122 provides for movement of the photo diode 102 and the optical assembly 104 relative to the measured side 96. In another aspect, the mechanism 122 also provides for movement of the light source 100 relative to the measured side 96, wherein the photo diode 102 remains stationary relative to the light source 100 (e.g., accomplished by a mechanical link, represented by dashed line 126) (i.e., the light source 100, photodiode 102 and optical assembly 104 all more together). Mechanism 122 may comprise, for example, a solenoid, a motor (e.g., a stepper motor), a spring catch/release mechanism, a crankshaft, or other electrical, mechanical or electromechanical device. Mechanism 122 is operational for continuously scanning measured side 96 by media stack component measuring system 32. As such, as sheets are removed from media stack 36, indicated by arrow 130, media stack component measuring system 32 operates to continuously update the quantity of sheets contained within media stack 36.

Figure 4:
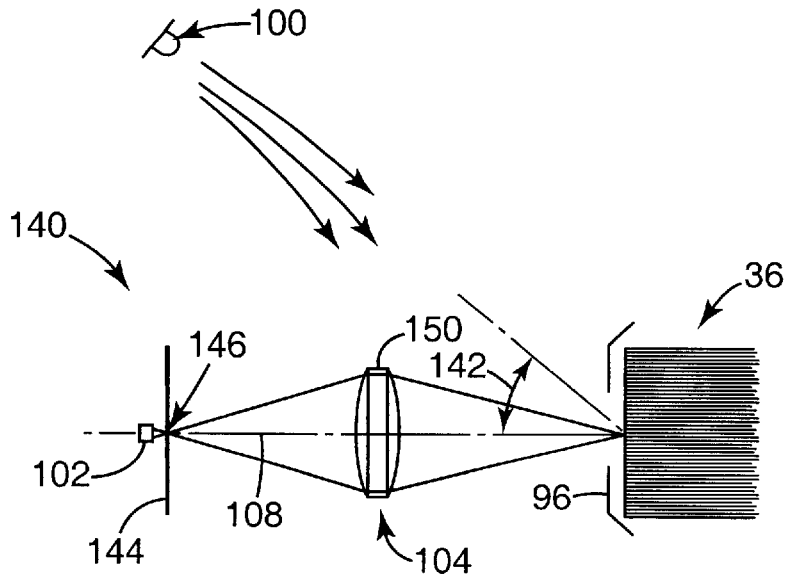
FIG. 4 is an optical diagram illustrating one exemplary embodiment of a media stack component measuring system according to the present invention.

FIG. 4 is an optical diagram illustrating a side view of light source 100, optical assembly 104 and photo diode 102, generally at 140. In one aspect, light source 100 is positioned "above" photo diode 102, and illuminates measured side 96 at a 45 degree angle relative to optical path 108, indicated at 142. In one aspect, optical light source 100 is a point light source. In one preferred embodiment, light source 100 is a light emitting diode (LED). Light source 100 may provide a "fixed" or pulsed illumination (e.g., 100 kilohertz). In one embodiment, light source 100 provides a pulsed illumination at a frequency different than 60 hertz.

In one embodiment, optical assembly 104 is positioned between photo diode 102 and measured side 96. Additionally, a mask 144 is positioned along optical path 108 between photo diode 102 and optical assembly 104. In one aspect, lens assembly 104 is positioned along optical path 108 at a center point between mask 144 and measured side 96, having a focal point at mask 144. Mask 144 includes an aperture 146, allowing light to pass through the mask 144 such that it is incident on photo diode 102.

In one preferred embodiment, optical assembly 104 includes lens system 150, which in one embodiment is an astigmatic lens. An astigmatic lens is defined as a lens having the following characteristics: the focal length in one axis of the lens is different than the focal length in the axis perpendicular to it, resulting in a circle being imaged as an oval or other useful shape at the focal plane. This may be used to project an image on the photo detector wherein the imaged area of stack 36 along edge 96 in the vertical direction is very small; while the imaged area of stack 36 along edge 96 in the horizontal direction is large. This effectively images a line-oriented parallel to the edge of the paper stack and increases the sensitivity of the detector to the media edge significantly. It also improves the rejection of noise from edge irregularities or particulate matter along the edge.

In one aspect, the lens is made of molded plastic. U.S. Precision Lens, Incorporated is one source for a suitable molded plastic lens. Other suitable lens types include plano-convex cylinder lens. Other suitable lens types will become apparent to one skilled in the art after reading this application.

Figure 5:
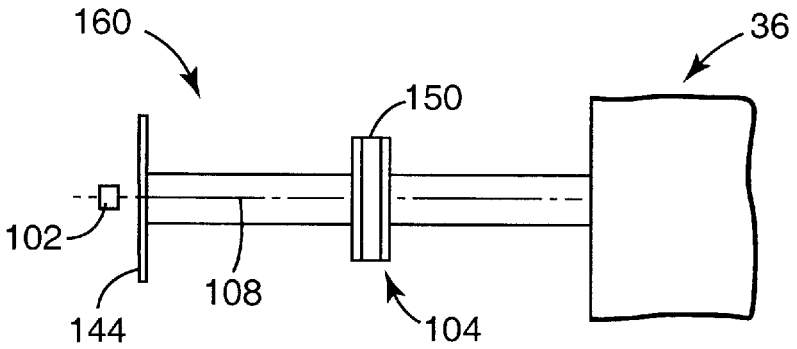
FIG. 5 is an optical diagram illustrating another exemplary embodiment of a media stack component measuring system according to the present invention.

FIG. 5 is an optical diagram illustrating a "top" view of the optical diagram of FIG. 4, generally at 160. In optical diagram 160, the imaged area of stack 36 is a line.

Figure 6:
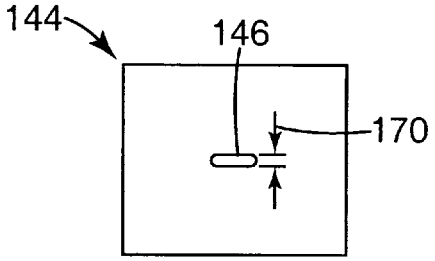
FIG. 6 is a diagram illustrating one exemplary embodiment of a mask used in an imaging system having a media stack component measuring system according to the present invention.

FIG. 6 is a diagram illustrating one exemplary embodiment of mask 144. Mask 144 includes aperture 146, which in one embodiment is substantially "oval" shaped. Preferably, aperture 146 has a width, indicated at 170, which is smaller than a measured width or thickness of a sheet from media stack 36. Additionally, the size of aperture 146 corresponds to the size of optical spot reflected from measured side 96. Mask 144 can be made of a metallic or non-metallic material (e.g., stainless steel, cardboard, etc.).

Figure 7:
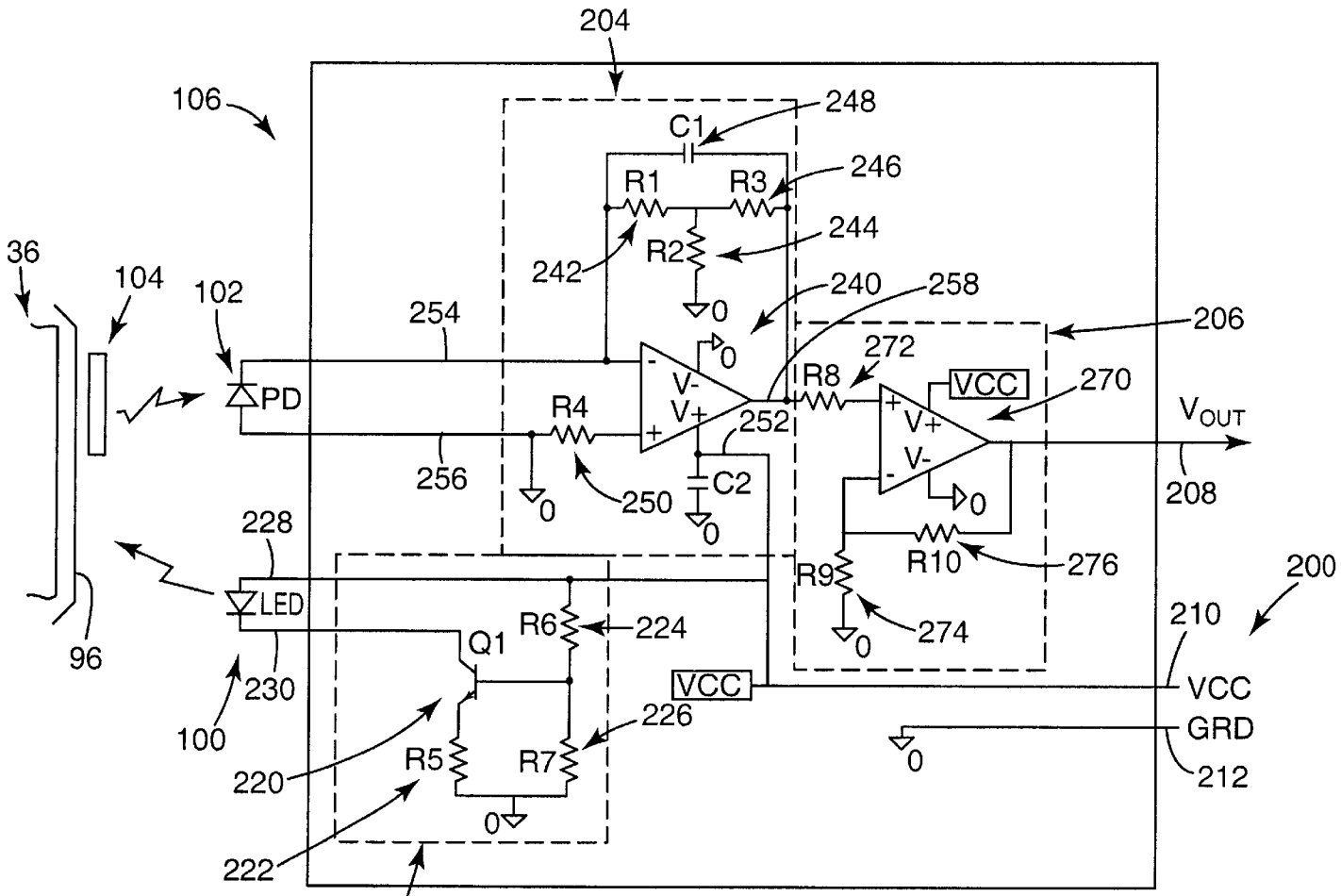
FIG. 7 is an electrical diagram illustrating one exemplary embodiment of a sensor circuit used in media stack component measuring system according to the present invention.

FIG. 7 is a diagram illustrating one exemplary embodiment of a sensor circuit, generally at 106. In operation, control circuit 106 provides an output voltage to drive LED 100. Additionally, control circuit 106 receives an input signal via photo diode 102 representative of sheet characteristics contained in sheet stack 36, and provides a corresponding output signal 208 (V out).

In one exemplary embodiment, control circuit 106 includes power supply input 200, current source 202, transimpedance amplifier 204, and output buffer 206. In operation, current source 202 is configured to drive LED 100. Transimpedance amplifier 204 receives an input signal via photo diode 102 representative of sheet characteristics of sheet stack 36. Transimpedance amplifier receives a current input from photo diode 102 and provides a voltage output signal 258 which is proportional to the current input signal. Buffer 206 provides a buffer between transimpedance amplifier output signal 258 and control circuit output 208. In one embodiment, buffer 206 also provides a signal gain of greater than 1.

Power supply input 200 is coupled across VCC 210 and ground 212 (GRD). In one aspect, the voltage potential between VCC 210 and ground 212 is plus 5 volts. In one aspect, current source 202 is a transistor current source. Current source 202 includes transistor 220 (Q1), resistor 222 (R5), resistor 224 (R6) and resistor 226 (R7). Current source 202 is positioned between VCC 210 and ground 212, and is operable to drive light source 100. Current source 202 is coupled across LED 100 at 228 and 230.

In one aspect, transimpedance amplifier 204 includes operational amplifier 240, resistor 242 (R1), resistor 244 (R2), resistor 246 (R3), capacitor 252 (C2). Photo diode 102 is coupled to the negative input of operational amplifier 240 at 254. Additionally, photo diode 102 is coupled to the positive input of operational amplifier 240 through resistor 250. In reference to operational amplifier 240, capacitor 252 is coupled between V positive (VCC 210) and ground providing decoupling of the power rail. The output 258 of transimpedance amplifier 204 is provided as an input to buffer 206. In particular, buffer 206 includes operational amplifier 270, resistor 272 (R8), resistor 274 (R9), and resistor 276 (R10). In one aspect, buffer 206 is an amplifier circuit having a non-inverting configuration. In one aspect, buffer 206 has a signal gain greater than 1. In one aspect, resistor 272 is coupled to the positive input terminal of amplifier 270. Resistor 274 is coupled between the negative input terminal of amplifier 270 and ground. Resistor 276 is coupled between resistor R9 and output 208. V positive is coupled to VCC 210. V negative is coupled to ground.

The following table illustrates one exemplary embodiment of component values for control circuit 106:

| | | | | |
|---|---|---|---|---|
| R1 = 10 Meg | R2 = 10K | R3 = 90.9K | R4 = 10 Meg | R5 = 100 |
| R6 = 464 | R7 = 562 | R8 = 10K | R9 = 19.6K | R10 = 19.6K |
| C1 = .2 pF | C2 = 0.1 uF | VCC = +5 | | |

Figure 8:
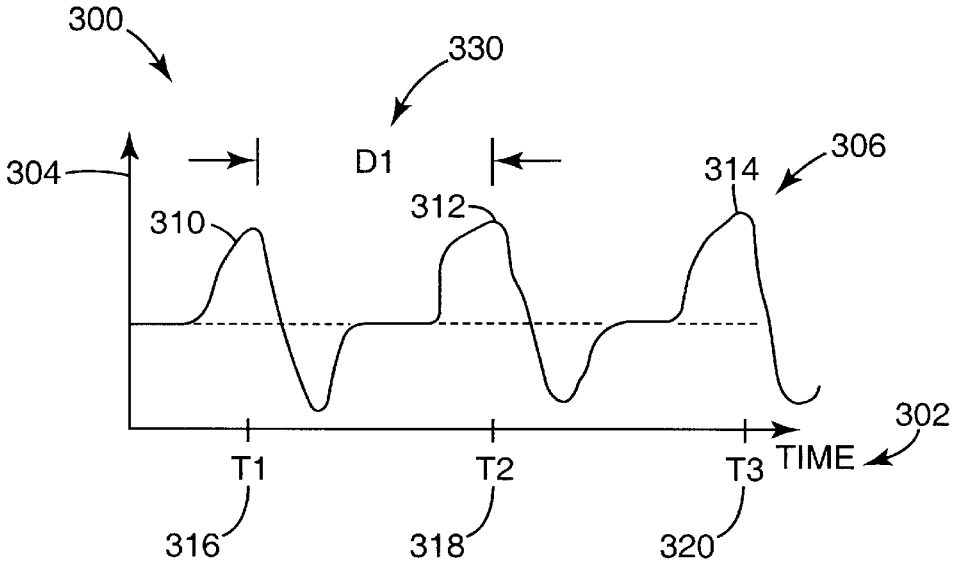
FIG. 8 is a diagram illustrating one exemplary embodiment of an output signal having components representative of media characteristics from a media stack component measuring system according to the present invention.

FIG. 8 is a diagram illustrating one exemplary embodiment of output signal 208 generally at 300. Output signal 208 includes characteristic components representative of sheet stack 36. Diagram 300 includes a first axis 302 representing time and a second axis 304 representative of signal magnitude. In one aspect, output signal 306 includes a first peak 310, a second peak 312, and a third peak 314, which can be termed as "sheet number components". As media stack component measuring system 32 is scanned across measured edge or side 96, each signal peak 310, 312 and 314 represents a piece of sheet media. As such, the total number of sheets in media holder 34 can be determined by detecting and counting each output signal peak 310, 312, 314. The thickness of each media sheet corresponds to the time between signal peaks, which can be termed as "sheet thickness components". For example, signal peak 310 occurs at time 316 (T1), signal peak 312 occurs at time 318 (T2) and signal peak 314 occurs at time 320 (T3). The thickness of the sheet media contained in media holder 34 is determined by the distance 330 (D1) between signal peak 310 at time 316 and signal peak 312 at time 318.

Figure 9:
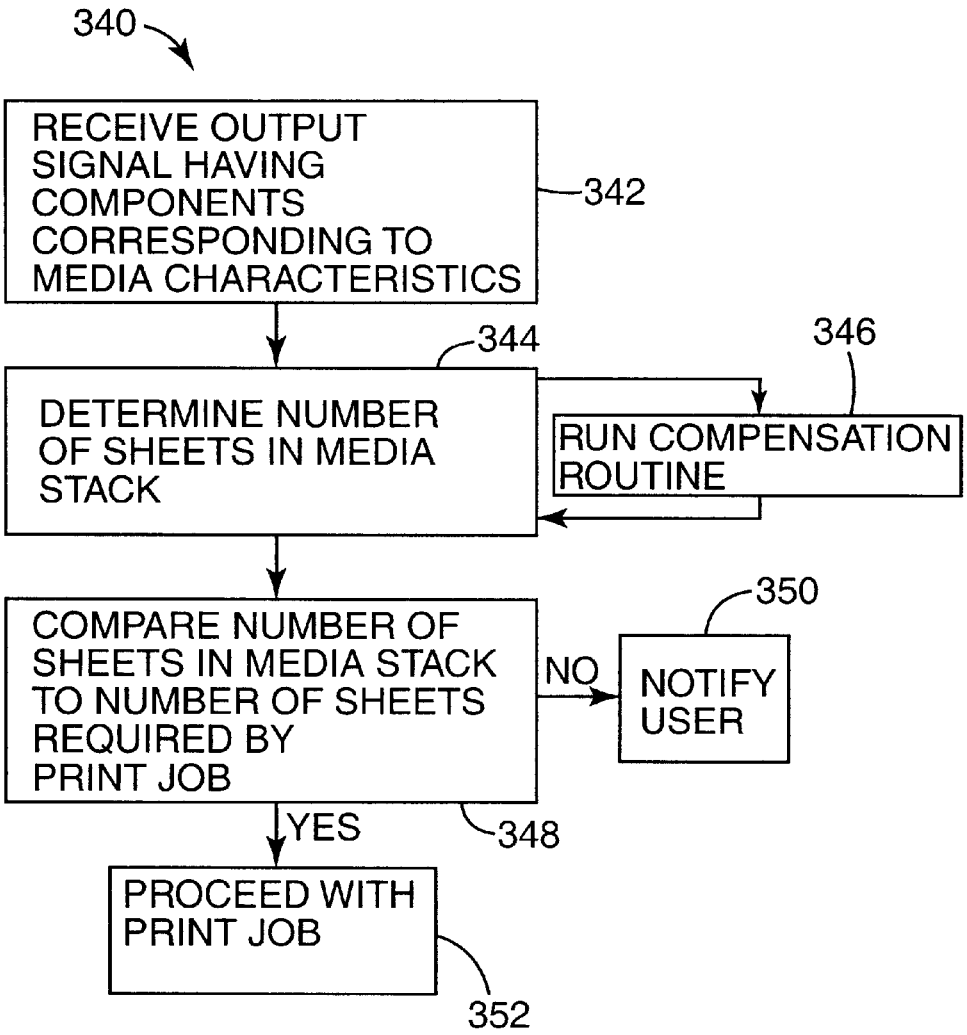
FIG. 9 is a flow chart illustrating one exemplary embodiment of a method of operating an imaging system according to the present invention.
Figure 10:
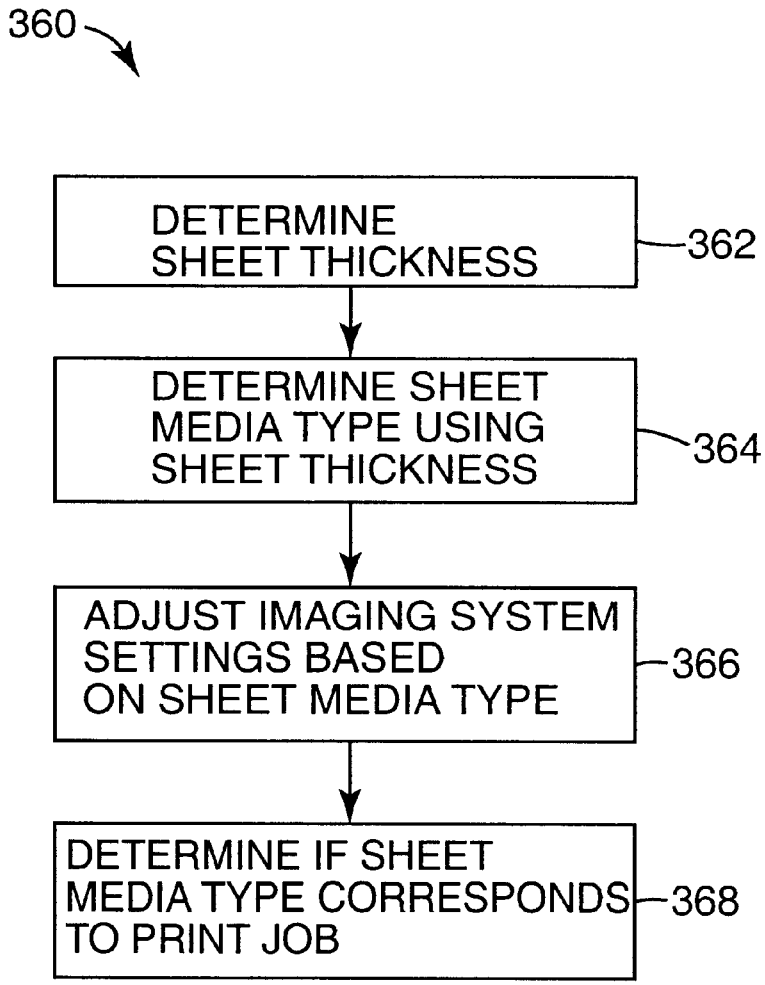
FIG. 10 is a flow chart illustrating one exemplary embodiment of a method of operating an imaging system according to the present invention.

FIG. 9 and FIG. 10 are flow charts illustrating exemplary embodiments of the operation of media manager 77. FIG. 9 is a flow chart illustrating one exemplary embodiment of using output signal 106 to determine the number of sheets in a media stack, indicated generally at 340. At 342, output signal 106 is received having components corresponding to media characteristics. In one aspect, output signal 106 is received by microprocessor 72. At 344, the media manager determines the number of sheets in the media stack. In one aspect, microprocessor 72 includes a peak detector for counting the number of peaks in output signal 106 which corresponds to the number of sheets in media stack 36. In one aspect, a compensation routine 346 determines or "compensates" for the number of peaks detected where the output signal includes a consistent number of peaks, a signal in consistency (e.g., due to a rough or overlapping paper edge), again followed by a consistent number of peaks.

At 348, the number of sheets in the media stack as compared to the number of sheets required by the print job. At 350, if the required number of sheets is not in the media holder, the user is notified. The user may be notified via an output at imaging system 30 control panel 80, or the user may be notified via a network connection through host 86. In another aspect, if the required number of sheets exist, at 352 the media manager allows the imaging system 30 to proceed with the print job.

FIG. 10 is a flow chart illustrating one exemplary embodiment of using a sheet thickness component and an imaging system, generally at 360. At 362, sheet thickness is determined. In one aspect, sheet thickness is determined by the media manager. The media manager operates to sample output signal 106, measuring the time between detected peaks. Based on the time between detected peaks and the known scanning speed, sheet thickness can be determined via the relationship thickness equals scan velocity multiplied by peak to peak time.

At 364, sheet media type is determined using the sheet thickness component. In one aspect, a table is stored in memory having thickness values or ranges associated with each sheet media type. Once a sheet thickness is determined, the table is scanned for the correct sheet thickness value, and the corresponding sheet media type may be identified. At 366, once the sheet media type is known, the imaging system settings can be adjusted based on the sheet media type. In particular, imaging system settings can be optimized for each sheet media type. For example, sheet media having a greater thickness may have different toner density requirements or fuser setting requirements relative to sheet media of less thickness.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An imaging system comprising:

a printer engine;

a printer control system in communication with the printer engine;

a media holder for holding a media stack including a plurality of sheets; and a media stack component sensing system which provides an output signal having a thickness component representative of sheet thickness of the sheets in the media stack, wherein the media stack component sensing system provides the output signal to the printer control system, wherein the output signal is a waveform having a plurality of peaks, and wherein the thickness component includes the distance between peaks.

2. The system of claim 1, wherein the printer control system is configured to determine a type of sheet using the component.

3. An imaging system comprising:

a printer engine;

a printer control system in communication with the printer engine;

a media holder for holding a media stack including a plurality of sheets; and a media stack component sensing system which provides an output signal having a thickness component representative of sheet thickness of the sheets in the media stack, the output signal including a sheet number component representative of the number of sheets in the media stack, wherein the output signal is a wave form having a plurality of peaks, and wherein the sheet number component corresponds to the number of peaks.

4. A system for use in an imaging system comprising:

a media stack component sensing system which provides an output signal having a thickness component representative of sheet thickness, wherein the media stack component sensing system provides the output signal to a printer control system, wherein the output signal is a waveform having a plurality of peaks, and wherein the thickness component includes the distance between peaks.

5. The system of claim 4, wherein the printer control system is configured to determine a type of sheet using the thickness component.

6. A system for use in an imaging system comprising:

a media stack component sensing system which provides an output signal having a thickness component representative of sheet thickness, the output signal including a sheet number component representative of the number of sheets in the media stack, wherein the output signal is a waveform having a plurality of peaks, and wherein the sheet number component corresponds to the number of peaks.

7. An imaging system comprising:

a printer engine;

a printer control system a media holder for holding a media stack including a plurality of sheets;

a media stack component sensing system including a light source, a photodiode, a lens assembly and a sensor circuit which provides an output signal having a thickness component representative of sheet thickness, wherein the output signal is a waveform having a plurality of peaks, and wherein the thickness component includes the distance between peaks.

8. The system of claim 7, the output signal including a sheet number component representative of the number of sheets in the media stack.

9. The system of claim 7, wherein the light source is a point light source.

10. The system of claim 7, wherein the light source is a light emitting diode.

11. The system of claim 7, the lens assembly including an astigmatic lens.

12. The system of claim 7, comprising a mask positioned between the photodiode and the lens assembly.

13. The system of claim 7, comprising a sheet registration system.

14. An imaging system comprising:

a printer engine;

a printer control system;

a media holder for holding a media stack including a plurality of sheets;

a media stack component sensing system including a light source, a photodiode, a lens assembly and a sensor circuit which provides an output signal having a thickness component representative of sheet thickness, comprising a mechanism for moving the photodiode relative to the stack.

15. The system of claim 14, wherein the photodiode is stationary relative to the lens system.

16. The system of claim 14, wherein the photodiode is stationary relative to the light source.

17. The system of claim 14, wherein the mechanism includes a solenoid.

18. The system of claim 14, the sensor circuit comprising a current source and a transimpedance amplifier.

19. The system of claim 18, the sensor circuit further comprising a buffer.

20. An imaging system comprising:

a printer engine;

a printer control system a media holder for holding a media stack including a plurality of sheets;

a sheet registration system configured to register a measured side of the media stack; and a media stack component sensing system including a light source operably positioned to illuminate the measured side of the media stack, a photodiode, a lens assembly positioned along an optical path between the photodiode and the measured side of the media stack, and a sensor circuit coupled to the photodiode which provides an output signal having a thickness component representative of sheet thickness.

21. The system of claim 20, the output signal including a sheet number component representative of the number of sheets in the media stack.

22. The system of claim 20, wherein the light source is a point light source.

23. The system of claim 20, the lens assembly including an astigmatic lens.

24. The system of claim 20, comprising a mask positioned along the optical path between the photodiode and the lens assembly, the mask including an aperture having a size corresponding to a desired spot size at the measured side of the media stack.

25. The system of claim 20, comprising a mechanism for moving the photodiode relative to the stack.

26. The system of claim 20, the sensor circuit comprising a current source and a transimpedance amplifier.

27. A method of processing a print job in an imaging system comprising:

scanning a sheet media stack at a registered edge;

generating an output signal having one or more sheet media components representative of characteristics of the sheet media stack; and using the output signal to process the print job, including determining a sheet media type using the sheet media component.

28. A method of processing a print job in an imaging system comprising:

scanning a sheet media stack at a registered edge;

generating an output signal having one or more sheet media components representative of characteristics of the sheet media stack; and using the output signal to process the print job, including determining print job processing settings using the sheet media component.

29. The method of claim 28 comprising:

defining the sheet media component to be a sheet number component.

30. A method of processing a print job in an imaging system comprising:

scanning a sheet media stack at a registered edge;

generating an output signal having one or more sheet media components representative of characteristics of the sheet media stack; and using the output signal to process the print job, including defining the sheet media component to be a sheet thickness component.

* * * * *